United States Patent [19]

Bochan

[11] 4,043,158

[45] Aug. 23, 1977

[54] LIQUID FLOW MECHANICAL DIVERTER VALVE

[75] Inventor: John Bochan, Louisville, Ky.

[73] Assignee: General Electric Company, Louisville, Ky.

[21] Appl. No.: 701,215

[22] Filed: June 30, 1976

[51] Int. Cl.[2] ..... D06F 39/02

[52] U.S. Cl. ..... 68/17 R; 137/599; 68/207; 137/612; 137/612.1; 137/624.18

[58] Field of Search ..... 137/612, 612.1, 608, 137/599, 624.18; 68/17 R, 624.18

[56] References Cited

U.S. PATENT DOCUMENTS

| | | | |
|---|---|---|---|
| 3,174,652 | 3/1965 | Villemure | 137/612 X |
| 3,513,866 | 5/1970 | Boothe | 137/803 UX |
| 3,589,150 | 6/1971 | Poletiek | 68/17 |
| 3,727,434 | 4/1973 | Bochan | 68/17 |
| 3,754,576 | 8/1973 | Zetterstrom | 137/829 |
| 3,760,612 | 9/1973 | Bochan | 68/17 |
| 3,797,527 | 3/1974 | Bain | 137/832 |

*Primary Examiner*—Alan Cohan
*Attorney, Agent, or Firm*—Frederick P. Weidner; Francis H. Boos

[57] ABSTRACT

An improved liquid flow mechanical diverter valve of the stream interaction type is provided. The valve includes a housing having an inlet for receiving a flow of liquid from a liquid source, a pair of first channels communicating with the inlet, each having an exit port, an interaction chamber, a pair of converging second channels between the exit ports and the interaction chamber, three exit areas directed away from the interaction chamber and two flapper assemblies, each having a first portion large enough to seat against and cover a first channel exit port, a second portion at an angle to the first portion and rigidly secured thereto, a pivot at the junction of the first and second portions, the second portions being spaced from and directed toward each other. A spring is associated with the second portion to urge the second portion away from the valve housing a sufficient distance to have the first portion seated against the first channel exit port, said spring having a force insufficient to prevent flow water through the exit port. A pivotal arm assembly having three positions movable by a mechanical push-pull actuator such that in only two of the positions the assembly selectively registers with one of the second portions to act as a stop to retain the first portion seated against the exit port during a predetermined period of time of liquid flow through the inlet.

11 Claims, 6 Drawing Figures

LIQUID FLOW MECHANICAL DIVERTER VALVE

BACKGROUND OF THE INVENTION

1. Field of the Invention

The present invention relates to a mechanical liquid flow diverter valve of the stream interaction type and more particularly, to an automatic washer having an additive dispensing system including a multi-compartmented dispenser making use of such a liquid flow diverter valve for flushing additives from the dispenser into the washer at predetermined times during a washing cycle.

2. Description of the Prior Art

Liquid flow diverter valves generally are classified in two groups: stream interaction control and boundary layer control. Diverter valves of the stream interaction type have been disclosed in U.S. Pat. Nos. 3,180,346—Duff; 3,415,262—Chatman; 3,016,063—Hausemann; and 3,797,527—Bain. Duff reveals a diverter valve which accomplishes the object by controlling the relative distances from the primary stream of the discharge orifices admitting the secondary streams. Chatman reveals an improvement in diverter valves wherein fluid under pressure is directed in the form of a jet against the side of the main stream in an interaction chamber thereby causing diversion of the main stream. Hausmann shows the use of mixed boundary layer and stream interaction control to effect diversion wherein control jets pump fluid from an area opposite the control jet to reduce the pressure on the opposite side of the main stream thereby improving the effectiveness of the control jet deflecting the main stream. Bain shows a lateral thrust unit in which the deliberately unstable nature of the design is overcome by bleeding off relatively large proportions of the incoming liquid flow for reintroduction as control jets.

It is desirable that such a diverter valve have the capabilities of diverting a liquid stream in a plurality of paths and furthermore, that these diverted streams flow in relatively constant paths across a wide range of input pressures from a liquid source. It is also desirable that the diverting means be mechanically operated and as inexpensively as possible, but reliable in its operation.

Furthermore, in an automatic washing machine, it is desirable that additives be dispensed automatically. When the dispensing of additives is automatic, the user may load the fabrics to be washed into the wash tub and place the additives into their proper compartments or containers, and the machine automatically completes the cycle of operations. Better results are obtained if these various additives are dispensed with water so that the additives are metered into the wash tub and evenly distributed therethrough. In U.S. Pat. Nos. 3,727,434—Bochan and 3,760,612—Bochan et al both assigned to the same assignee as the present invention, there are shown automatic washers for carrying out such operations. Additive dispensing systems are disclosed therein which make use of a liquid flow diverter for supplying water to the appropriate compartments of an additive dispenser such that additives may be dispensed into the washing machine automatically during the appropriate portion of the washing cycle.

Prior art as in U.S. Pat No. 3,513,866—Boothe et al also assigned to the same assignee as the present invention, shows a fluid amplifier or liquid flow diverter for selectively diverting a stream of water for dispensing additives from separate compartments into the wash tub of an automatic washing machine. U.S. Pat. No. 3,589,150—Poletiek et al. also shows a liquid flow diverter of the stream interaction type useful to dispense additives in a washing machine. The machine has a flushing basin divided into at least three compartments for holding detergents. The detergents are flushed by water supplied by conduits directed to the various compartments. Two water conduit branches participate in emptying at least one of the compartments.

By the present invention, there is provided an improved liquid flow diverter valve particularly useful in an automatic washing machine for selectively flushing additives from the respective compartments of a multi-compartmented additive dispenser. The diverter valve of this invention provides a mechanical means of diverting liquid requiring very little force to operate, it is of low cost, and yet is efficient in its operation.

SUMMARY OF THE INVENTION

In accordance with the present invention, there is provided in a liquid flow mechanical diverter valve of the stream interaction type including a housing having an inlet for receiving a flow of liquid from a liquid source, a pair of first channels communicating with the inlet, said channels each having an exit port, an interaction chamber in the valve housing, a pair of converging second channels between the exit ports of the first channels and the interaction chamber, three exit areas directed away from the interaction chamber, means associated with the exit ports of the first channels for effecting opening and closing thereof at predetermined times for controlling the flow of liquid therefrom, an improved liquid flow mechanical diverter valve. The improvement comprises two flapper assemblies, each having a first portion large enough to seat against and cover a first channel exit port, a second portion at an angle to the first portion and rigidly secured thereto, a pivot at the junction of the first and second portions, the second portions being spaced from and directed toward each other. A spring is associated with the second portion to urge the second portion away from the valve housing a sufficient distance to have the first portion seated against the first channel exit port, said spring having a force insufficient to prevent the flow of water through the exit port. There is also provided a pivotal arm assembly having a pivot pin, two tangs radially outward of the pivot pin, a lever and a mechanical push-pull actuator secured to the lever to pivot the assembly to three selected positions. Only two of the positions of the assembly selectively register one of the tangs with one of the second portions to act as a stop to retain the first portion seated against the exit port during a predetermined period of time of liquid flow through the inlet.

It is an object of the present invention to provide an improved liquid flow mechanical diverter valve of the stream interaction type.

It is a further object to provide, in an automatic washing machine including an additive dispensing system, a liquid flow diverter valve of the stream interaction type capable of selectively diverting liquid into preselected dispenser compartments at predetermined times.

DESCRIPTION OF THE PREFERRED EMBODIMENT

Figure 1:
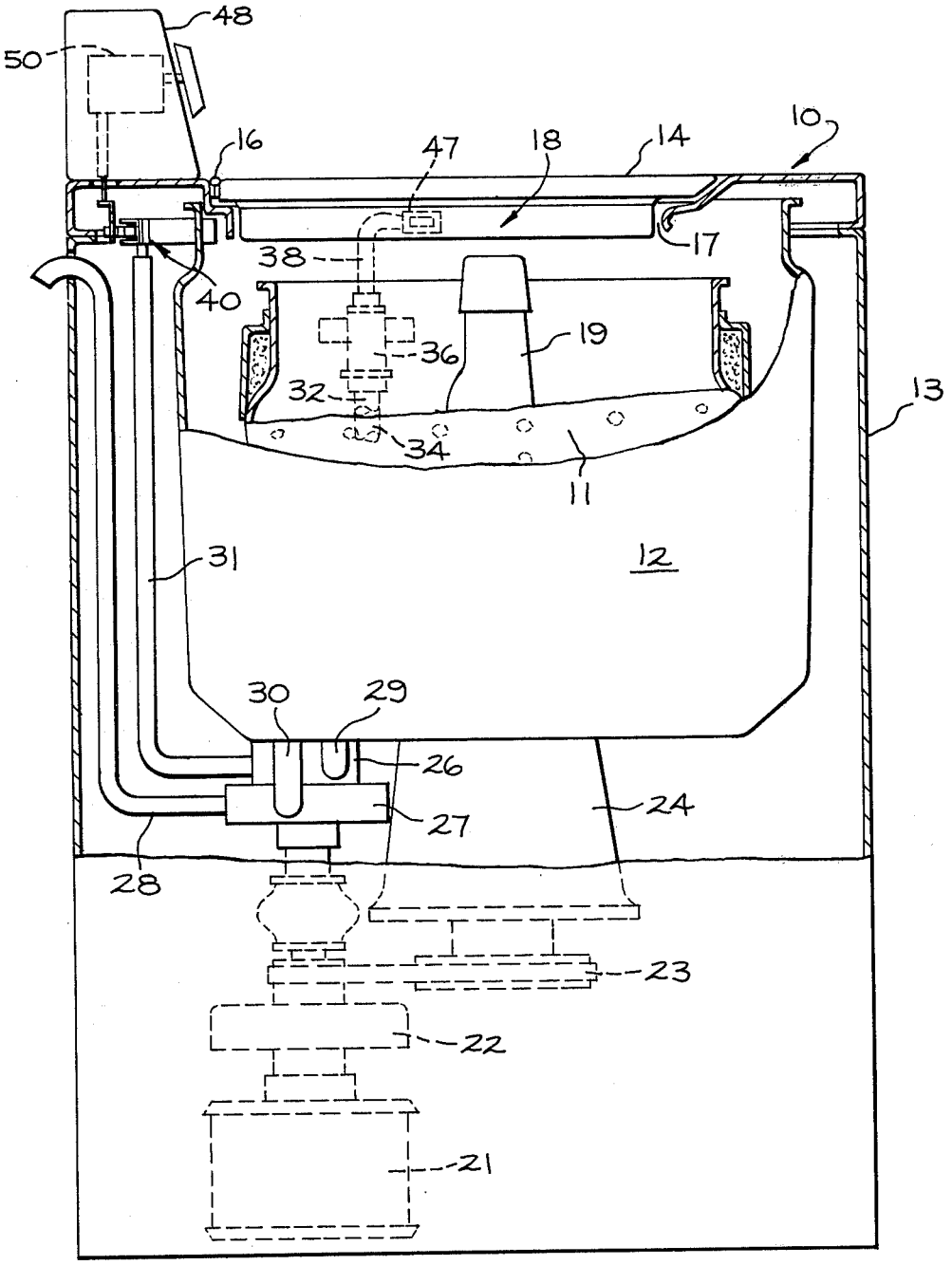
FIG. 1 is a side elevational view of an automatic clothes washer incorporating one embodiment of the present invention, the view being partly broken away and partly in section.

Referring now to FIG. 1, there is shown an automatic washer such as clothes washing machine 10 of the vertical axis type having a conventional perforated wash tub or basket 11 disposed within an outer imperforate liquid retaining tub 12. With this combination, the tubs 11 and 12 form suitable means for containing liquid and the clothes to be washed therein. Outer tub 12 is rigidly mounted within an appearance cabinet 13 which includes a cover such as access lid 14 hingedly mounted on a hinge rod 16 on the top portion of the cabinet 13 for providing access to an opening 17 to the basket 11.

Shown positioned over the basket 11 and projecting into the opening 17 is a wash liquid treating agent dispenser 18 which forms a portion of an additive dispensing system. Such a system may, if desired, be of the type described in U.S. Pat. No. 3,727,434—Bochan and 3,760,612—Bochan et al, both assigned to the same assignee as the present invention. Preferably this is effected by removably and hingedly mounting the dispenser 18 to the underside of the access lid by suitable means to be described hereinafter in detail. At the center of the basket 11 there is positioned an agitator 19 for flexing clothes during a washing operation. Conventionally, the basket is mounted for rotation and the agitator is mounted for some type of oscillatory motion which will effect washing action on the clothes in the basket.

Basket 11 and agitator 19 are driven from a reversible motor 21 through a drive means including a clutch 22 which, through a suitable belt 23, transmits power to a transmission 24. When the motor 21 is rotated in one direction, the transmission causes a slow speed oscillation of the agitator 19. When the motor is driven in the opposite direction, the transmission drives both basket and agitator at a high speed for centrifugal extraction of the liquid from the clothes.

In addition to operating the transmission 24 as described, motor 21 also provides a direct drive to a pump structure which includes separate pumping units 26 and 27. During the high speed operation, pump unit 27 draws liquid through conduit 30 from the outer tub 12 and discharges it through conduit 28 coupled ordinarily to a household sewage disposal system. During wash or slow speed, pump unit 26 draws liquid from tub 12 through conduit 29 and discharges through a single conduit 31 which extends up to and terminates at a liquid flow mechanical diverter valve 40 which will hereinafter be described in detail. Diverter valve 40 is fixedly mounted on the cabinet top and has its outlet end provided with a plurality of outlet areas 42, 44 and 46 (clearly shown in FIG. 2) arranged to cooperate selectively with suitable inlets in dispenser 18 in a manner that will be disclosed later in the description of the operation of the present invention.

Also provided are means for coupling to a liquid source such as the household water system. Included are a pair of conduits or hoses 32 and 34 for coupling to the hot and cold water faucets respectively. Hoses 32 and 34 are coupled to a solenoid actuated valve 36. Conduit 38 extends up to and terminates at a nozzle 47.

Mounted on the cabinet 13 is a control compartment 48 within which are located control devices, including a cycle controller such as sequence control timer 50, which serves to conduct the washing machine and the diverter valve 40 through the various cycles of operation. Usually these types of timers effect control by cam surfaces on a cam, such as cam 51, diagrammatically shown in FIG. 4, as is well known in the art.

Figure 2:
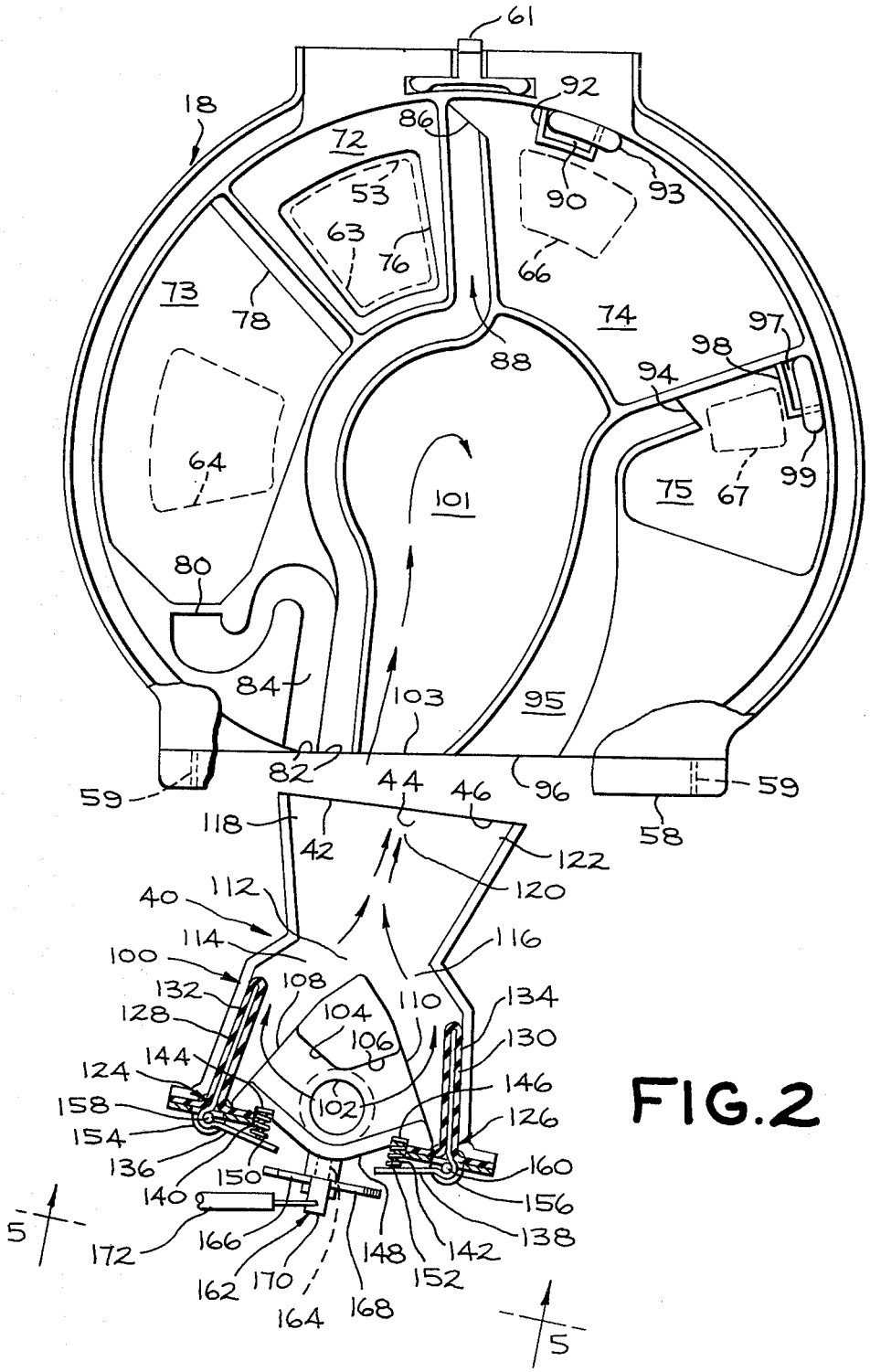
FIG. 2 is a view of the liquid flow mechanical diverter valve of the present invention showing partly in section the liquid diverter and the additive dispenser which may be associated therewith.

Referring now to FIG. 2, there is shown dispenser 18 with its top removed wherein a straight portion 58 is provided with a pair of bifurcated ears 59 formed integrally with the dispenser. The ears 59 engage the rod 16 which has its free end suitably journalled through the access lid 14 and into the cabinet top. Ears 59 and rod 16 form a hinge about which the dispenser 18 may be rotated independently of the access lid 14. The bifurcated ears 59 are dimensioned to allow the removal of the dispenser 18 from the machine when it is desirable not to dispense additives automatically or for easy cleaning of the dispenser away from the washing machine.

Diametrically opposite the portion 58, there is provided a latch member 61 which is adapted to engage a keeper or bracket on the lid 14 (not shown) for holding the dispenser in the latched position as seen in FIG. 1. In this latched position, the dispenser rotates with the lid 14 to an open position away from the opening 17 thereby exposing the basket 11 to the user for insertion of clothes to be washed and for their removal at the end of the wash operation.

Subsequent to filling the wash basket 11 with clothes to be washed and the determination is made to automatically dispense one or more treating agents into the machine tub, the dispenser 18 may be unlatched and rotated to the position shown in FIG. 2. In this down position the dispenser is accessible to the user of the machine for selectively inserting treating agents to be automatically dispensed during the washing operation into one or all of a plurality of openings 63, 64, 66 and 67 provided in the cover member (not shown) of the dispenser 18. Openings 63, 64, 66 and 67, shown as dotted lines, communicate with a plurality of compartments 72, 73, 74 and 75 respectively such that presoak agents placed in opening 63 must pass through compartment 72, detergent placed into opening 64 is stored in compartment 73, bleach placed into opening 66 is stored in compartment 74 and rinse agent placed into opening 67 is stored in compartment 75.

Unlike compartments 73, 74 and 75, compartment 72 is not designed to store a treating agent but provides a passageway for introducing prewash liquid treating agents directly into the basket 11 to be effective during the first fill cycle of the machine. To this end, the bottom wall portion of the compartment 72 has an opening 76 larger than the corresponding opening 53 to facilitate easy dispensing of the prewash agent.

Detergent or soap to be dispensed from compartment 73 during the wash cycle is usually in solid, granular, or high viscosity, water soluble form. The bottom wall of dispenser 18 is provided with a discharge outlet or opening 78 extending across substantially the entire width of the compartment 73. At the opposite end of the compartment 73 from opening 78 there is provided an opening 80 connected to an inlet area 82 by a passageway 84. Opening 80 is so dimensioned that water entering therethrough is directed in a fan-like stream over the full width of the bottom wall of compartment 73. This shallow, relatively high velocity discharge of water from opening 80 will encounter the detergent to undercut and intermix thoroughly therewith to effectively convey it along the bottom wall into outlet 78 and thence into basket 11. In practice, the flow of liquid through opening 80 continues after the detergent has been evacuated so there is no substantial residue within the chamber.

Bleach stored in compartment 74 is dispensed during the wash cycle subsequent to the dispensing of the detergent in a manner that will hereinafter be described. Extending into compartment 74 is the outlet end 86 of a channel or passageway 88 connecting the compartment 74 with the inlet area 82. Located in the bottom wall of compartment 74 is a discharge outlet 90 through which the bleach stored in compartment 74 is introduced into the basket 11. Bleach stored in the compartment 74 may be liquid and concentrated in form, therefore, to prevent liquid from draining into the basket prematurely, a wall or barrier 92 is located around the discharge outlet 90 in a manner that is effective to isolate compartment 74 from outlet 90. When the bleach is in concentrated form, the barrier allows mixing of the bleach stored in the compartment with water entering through outlet 86 and the mixture must rise above the top of barrier 92 before liquid can pass through opening 90. Provision is made to drain the compartment 74 when the water flow from outlet 86 terminates. A siphon 93 has its short leg (not shown) positioned within the chamber 74 and extending to a point adjacent the bottom wall thereof. The longer leg (not shown) of the siphon 93 extends down outside of the barrier 92 and is positioned within the outlet 90. The top or curved portion of the siphon passes through the barrier 92 at a point (not shown) below which the liquid drains over the barrier 92, it has also reached the top of the siphon at which point siphoning action starts with liquid draining through the siphon and through outlet 90. It will be observed that this action of draining through the siphon and outlet 90 will continue until the water entering the compartment 74 through outlet 86 terminates and then the mixture of bleach and water in the compartment will continue to flow out through the siphon until the chamber or compartment 74 is emptied.

Rinse agent which is dispensed during the rinse cycle is stored in compartment 75. Extending into compartment 75 is the outlet end 94 of a passageway 95 connecting compartment 75 with an inlet area 96. A provision for mixing rinse agent with water entering the compartment 75 and for draining the mixture from the compartment is similar to the arrangement provided within compartment 74. A discharge outlet 97 in the bottom wall is isolated from the compartment 75 by a barrier 98 and a siphon tube 99 is disposed to connect the compartment 75 with the outlet 97.

Water may pass directly into the underlying tub 12 and by-pass the dispenser 18 through opening 101 having an inlet area 103.

In accordance with the present invention, an improved liquid flow mechanical diverter valve for diverting recirculation flow of water in an automatic washer into dispenser inlet areas 82, 96 and 103 selectively and thereby into the appropriate dispenser compartments is provided. As seen in FIG. 2, there is presented a preferred embodiment of a liquid flow mechanical diverter valve 40 which is capable of providing recirculating water from conduit 31 selectively in a plurality of exit paths such as to the three outlet areas 42, 44 and 46 of diverter valve 40. Diverter valve 40 has a housing 100 provided with a main inlet 102 for receiving a flow of liquid such as recirculating water through conduit 31.

Referring now to FIGS. 2—5, the main inlet 102 allows water to flow into the housing 100 from a liquid source, which in the case of the preferred embodiment shown and described is from a recirculation water system where water is taken from the tub and pumped back into the basket. This may be used to effect filtering of the wash water if so desired. The water from pump unit 26 enters the mechanical diverter valve 40 via conduit 31. There is provided a pair of first channels 104 and 106 communicating with the main inlet 102 and the channels each have an exit port 108 and 110 respectively. Within the housing 100 there is an interaction chamber 112 and a pair of converging second channels 114 and 116 which are located between the exit ports 108 and 110 and the interaction chamber 112. Extending from the interaction chamber 112 are three exit channels 118, 120 and 122 which terminate at ports or areas 42, 44 and 46 respectively. It will be noted that exit channels 118 and 122 diverge away from each other and the interaction chamber 112.

There are two flapper assemblies 124 and 126, each having a first portion 128 and 130, respectively, large enough to seat against and cover the first channel exit ports 108 and 110 respectively. In the preferred embodiment, the flapper assemblies 124 and 126 are formed of metal and a resilient cover 132 and 134 is applied to the first portion adjacent the exit ports 108 and 110 to aid in effecting seal characteristics between the flapper assemblies 124 and 126 and the housing 100 and also the exit ports 108 and 110. By extending the resilient cover 132 and 134 to the housing 100 it will also act as a seal between the housing 100 and the flapper assemblies 124 and 126. At the other end of the flapper assemblies there is a second portion 136 and 138, respectively. These second portions are spaced from and directed toward each other and as shown generally in the drawings, they are at a right angle with respect to the first portions. A compression spring 140 and 142 has one end 144 and 146 secured to the rear wall 148 of housing 100. The opposite end 150 and 152 is secured to the second portions 136 and 138, respectively. These springs 140 and 142 exert a slight force against the second portions 136 and 138 to normally retain the first portions 128 and 130 in seated arrangement against the exit ports 108 and 110. At the junction 154 and 136 is a pivot 158 and 160. It should be noted that in this construction, second portions 136 and 138 are rigidly attached or secured to first portions 128 and 130.

A pivotal arm assembly 162 having a pivot pin 164 about which the pivotal arm assembly oscillates back and forth, also has two tangs 166 and 168 radially outward of the pivot pin and located on opposite sides of a lever 170.

Figure 5:
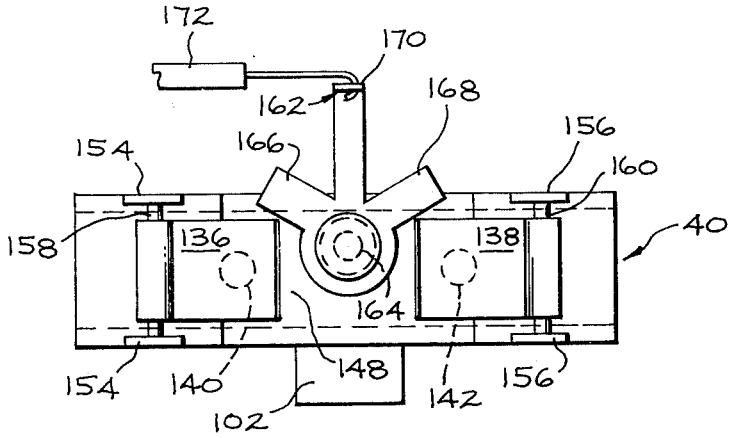
FIG. 5 is a view taken generally along the lines 5—5 of FIG. 2.

The lever 170 of the pivotal arm assembly 162 has attached to it a push-pull actuator 172 at one end thereof and the opposite end of the push-pull actuator is adapted by any suitable means to respond to a cam element 51 which is incorporated in the timer 50 so that the timer program will at appropriate times in the washing operation cause the push-pull actuator 172 to move the pivotal arm assembly to one of three positions. One of the three positions is shown in FIG. 5, which may be considered as a "neutral" wherein tangs 166 and 168 are not in position to register with either of the second portions 136 and 138 of the flapper assemblies 124 and 126, respectively. This condition, as shown in FIG. 5, and FIG. 2, will allow liquid coming in through the inlet 102 to pass through both channels 104 and 106 whereupon the liquid comes into contact with the first portions 128 and 130 and the force of the water causes these portions to be moved outwardly of the exit ports 108 and 110 by overcoming the light force applied by springs 140 and 142, causing the flapper assemblies 124 and 126 to assume the position as shown in FIG. 2. In this position then, the liquid passes into channels 114 and 116 whereupon the two streams meet in a converging manner in interaction chamber 112. Because of their converging force being substantially equal, these two streams are combined and flow through channel 120 leaving the diverter assembly housing 100 via outlet area 44 and enters the dispenser 18 through inlet area 103 and through opening 101 into the underlying tub 12. This water flow path is shown by arrows in FIG. 2. Because the two streams interact the velocity of the resultant stream is slow and is advantageous for the soak portion of the washing cycle when a filter pan (not shown) is used.

Figure 3A:
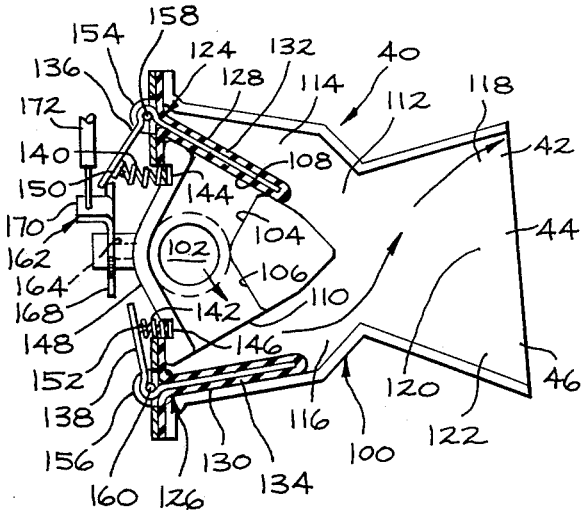
FIG. 3*a* and 3*b* are views of the liquid flow diverter valve of the present invention taken in section, showing various operating modes.
Figure 4:
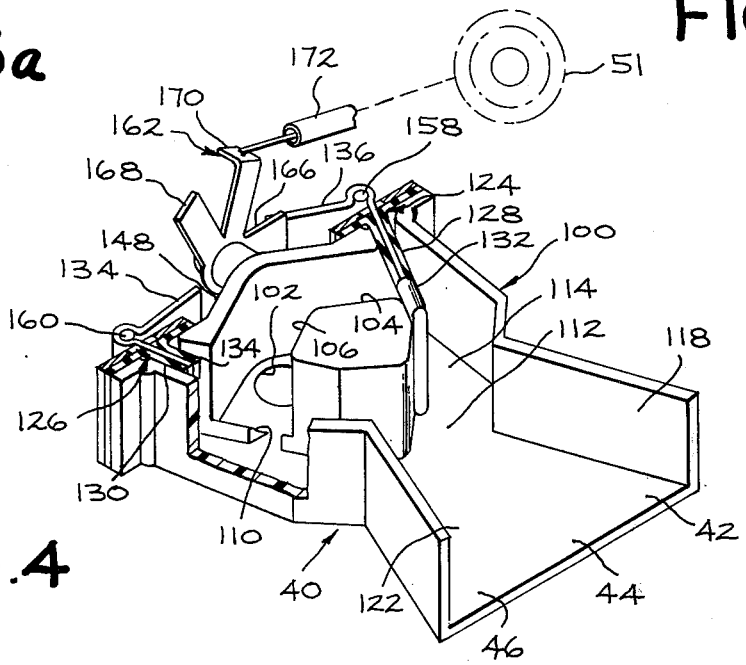
FIG. 4 is a perspective view of the mechanical diverter valve in the operating mode shown in FIG. 3*a*.

The timer cam 51 (FIG. 4) is arranged so that at the appropriate time in the washing cycle when it is desired to dispense detergent into the wash load and flushing of compartment 73 is necessary, then the timer cam 51 moves the push-pull actuator 172 to rotate the pivotal arm assembly 162 to the position shown in FIGS. 3a and 4 during a period when no liquid is flowing into the diverter valve. Because of the light compression spring force exerted during inoperation of the diverter valve it causes the flapper assemblies 124 and 126 to assume a neutral position, wherein the second portions 136 and 138 are urged away from the rear wall 148 of the housing 100. While the flapper assemblies are in that position, the push-pull actuator rotates the pivot arm assembly 162 so that tang 166 is interposed between the rear wall 148 and the second portion 136. When the machine controls call for liquid to flow through the inlet 102 and through the diverter valve, the liquid flowing into channel 104 will hit the first portion 128 but cannot force it to move away from its seated position against exit port 108 because tang 166 acts as a stop to prevent the assembly from unseating the first portion. Flapper assembly 126, however, is free to pivot under the influence of the liquid pressure or force and the liquid is permitted to flow through exit port 110 into channel 116 and will exit the diverter valve via interaction chamber 112, channel 118, and exit area 42 into inlet area 82 of the dispenser 18. This water flow path is shown by arrows in FIG. 3*a*. The flushing of the additives will then take place as described heretofore.

Toward the end of the washing cycle when it is desirable to flush the rinse agent from compartment 75, then the cam 51 of the timer 50 during a period when no liquid is flowing into the diverter valve, causes the push-pull actuator 172 to rotate the pivotal arm assembly 152 to the position wherein the tang 168 is interposed between the rear wall 148 of housing 100 and the second portion 138 of the flapper assembly 126.

Figure 3B:
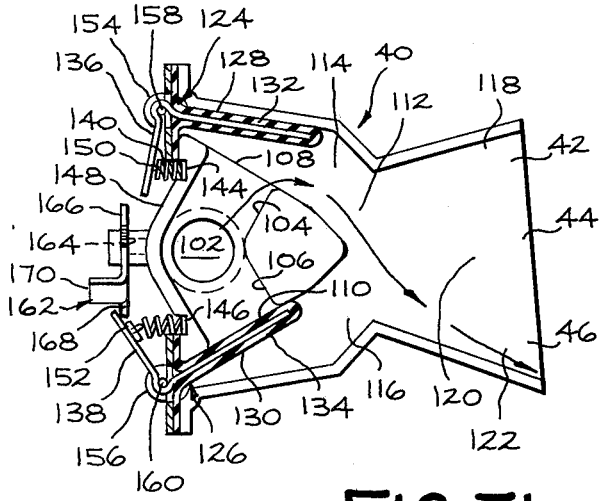

In this position then, when the machine controls again call for liquid to flow into the diverter valve via inlet 102, the force of the liquid cannot unseat the first portion 130 from the exit port 110 and therefore all the liquid will flow through channel 104 and force the first portion 128 of flapper assembly 124 away from exit port 108 to assume the position shown in FIG. 3*b* and thereby overcome the light spring force thus allowing the liquid to flow through channel 114 and exit the diverter valve via interaction chamber 112, channel 122 and outlet area 46 into the dispenser 18 via inlet area 96 thus allowing flushing of the rinse agent in compartment 75 as described heretofore. This water flow path is shown by arrows in FIG. 3b.

By the foregoing structural arrangement of the mechanical diverter valve and system there is provided an improved diverter valve that requires extremely light force to operate and will not overload the small timer motor. The need for solenoids to operate the valving means has been eliminated thus making the diverter valve less costly yet efficient in its operation. It has been found that any water leakage that might occur when the first portions 128 and 130 are seated against exit ports 108 and 110, respectively, is insignificant as the velocity of the stream going by the unseated first portion is so much greater that there is no detrimental effect on the stream.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. In a liquid flow mechanical diverter valve of the stream interaction type including a housing having an inlet for receiving a flow of liquid from a liquid source, a pair of first channels communicating with the inlet, said channels each having an exit port, an interaction chamber in the valve housing, a pair of converging second channels between the exit ports of the first channels and the interaction chamber, three exit areas directed away from the interaction chamber, means associated with the ports of the first channels for effecting opening and closing thereof at predetermined times for controlling the flow of liquid therethrough, the improvement comprising:

the diverter valve having two flapper assemblies each having a first portion large enough to seat against and cover a first channel exit port, a second portion at an angle to the first portion and rigidly secured thereto, a pivot at the junction of the first and second portions, the second portions being spaced from and directed toward each other, a spring associated with the second portion to urge the second portion away from the valve housing a sufficient distance to have the first portion seated against the first channel exit port, said spring having a force insufficient to prevent the flow of liquid through the exit port, a pivotal arm assembly having a pivot, two tangs radially outward of the pivot and a mechanical push-pull actuator secured to the arm assembly to pivot the arm assembly to three positions, only two of said positions selectively register one of the tangs with one of the second portions to act as a stop to retain the first portion seated against the exit port during a predetermined period of time of liquid flow through the inlet.

2. In the liquid flow mechanical diverter valve of claim 1 wherein the flapper assemblies are formed of metal and the first portion thereof adjacent the exit port is covered with a resilient material.

3. In the liquid flow mechanical diverter valve of claim 1 wherein the first channels diverge away from the inlet opening and each other.

4. In the liquid flow mechanical diverter valve of claim 1 wherein the springs are compression type springs.

5. In the liquid flow mechanical diverter valve of claim 1 wherein the two positions to selectively register one of the tangs with one of the second portions are on opposite sides of the third position.

6. In an automatic washer having a sequence control timer for conducting the washer through an operational cycle and an additive dispensing system including a multi-compartmented dispenser, a liquid flow mechanical diverter valve of the stream interaction type including a housing having an inlet for receiving a flow of liquid from a liquid source, a pair of first channels communicating with the inlet, said channels each having an exit port, an interaction chamber in the valve housing, a pair of converging second channels between the exit ports of the first channels and the interaction chamber, three exit areas directed away from the interaction chamber, means associated with the exit ports of the first channels for effecting opening and closing thereof at predetermined times for controlling the flow of liquid therethrough, the improvement comprising:

the diverter having two flapper assemblies each having a first portion large enough to seat against and cover a first channel exit port, a second portion at an angle to the first portion and rigidly secured thereto, a pivot at the junction of the first and second portions, the second portions being spaced from and directed toward each other, a spring associated with the second portion to urge the second portion away from the valve housing a sufficient distance to have the first portion seated against the first channel exit port, said spring having a force insufficient to prevent the flow of liquid through the exit port, a pivotal arm assembly having two tangs radially outward of the pivot and a mechanical push-pull actuator secured to the arm assembly to pivot the arm assembly to three positions, only two of said positions selectively register one of the tangs with one of the second portions to act as a stop to retain the first portion seated against the exit port during a predetermined period of time of liquid flow through the inlet.

7. The diverter valve of claim 6 wherein the sequence control timer utilizes cam elements for conducting the washer through an operational cycle and the push-pull actuator is operated by a cam element.

8. The diverter valve of claim 6 wherein the flapper assemblies are formed of metal and the first portion thereof adjacent the exit ports is covered with a resilient material.

9. The diverter valve of claim 6 wherein the first channels diverge away from the inlet opening and each other.

10. The diverter valve of claim 6 wherein the springs are compression type springs.

11. The diverter valve of claim 6 wherein the two positions to selectively register one of the tangs with one of the second portions are on opposite sides of the third position.

* * * * *